US006711845B2

(12) United States Patent
Dubois et al.

(10) Patent No.: US 6,711,845 B2
(45) Date of Patent: Mar. 30, 2004

(54) DISPLAY STAND FOR HANDGUN

(76) Inventors: Christian Dubois, 2500 Roland Therrien, Apt. 412, Longueuil, Quebec (CA), J4L 4G1; Gerry Boucher, 449 de Dieppe, Sainte-Julie, Quebec (CA), J3E 1C9

( * ) Notice: Subject to any disclaimer, the term of this patent is extended or adjusted under 35 U.S.C. 154(b) by 0 days.

(21) Appl. No.: 10/317,596

(22) Filed: Dec. 12, 2002

(65) Prior Publication Data

US 2003/0132354 A1 Jul. 17, 2003

(30) Foreign Application Priority Data

Dec. 17, 2001 (CA) ..... 2365927

(51) Int. Cl.[7] ..... F41A 29/00; F41A 31/00; F41A 9/62; F41C 27/00

(52) U.S. Cl. ..... 42/94; 248/125.1; 248/125.8; 248/157; 248/161; 248/176.3; 224/912

(58) Field of Search ..... 42/94; 224/912; 248/127, 125.1, 125.3, 125.8, 161, 157, 419, 176.3

(56) References Cited

U.S. PATENT DOCUMENTS 3,958,786 A * 5/1976 Mann ..... 248/176.3
4,265,045 A * 5/1981 Garbini ..... 42/94
4,836,425 A * 6/1989 McClellan ..... 224/163
4,903,425 A * 2/1990 Harris ..... 42/94
4,941,631 A * 7/1990 Misch et al. ..... 248/176.3
5,009,022 A * 4/1991 McCoy ..... 42/94
5,018,294 A * 5/1991 McGuffee ..... 42/94
5,074,188 A * 12/1991 Harris ..... 89/37.04
5,143,227 A * 9/1992 Schubert ..... 211/64
5,715,624 A * 2/1998 Hilbelink et al. ..... 42/94
5,930,931 A * 8/1999 Watson ..... 42/94
5,937,559 A * 8/1999 Jennen ..... 42/94
6,478,165 B1 * 11/2002 Noble ..... 211/4
6,487,807 B1 * 12/2002 Kopman et al. ..... 42/94

* cited by examiner

*Primary Examiner*—Ramon O. Ramirez
*Assistant Examiner*—Amy J Sterling
(74) *Attorney, Agent, or Firm*—Eric Fincham

(57) ABSTRACT

A display stand for a gun comprising a base having a stanchion extending upwardly therefrom and with a post movably mounted on the stanchion such that the post may be vertically adjusted with respect thereto, and a retaining assembly extending outwardly from a distal end of the post, the retaining assembly having first and second cooperative clamping members arranged to receive a gun barrel therebetween. The display stand includes various security features to prevent easy removal of a gun therefrom.

7 Claims, 1 Drawing Sheet

DISPLAY STAND FOR HANDGUN

FIELD OF THE INVENTION

The present invention relates to a display stand and more particularly, relates to a display stand suitable for a gun.

BACKGROUND OF THE INVENTION

There are many different types of display stands known for displaying different goods. The present invention is particularly directed to a display stand suitable for a handgun and may be used in showcases or on a table at an exhibition or the like. The display stand of the present invention may be used either by an individual in a residence or it is also suitable for use by a dealer or collector at a gun show or retail outlet or the like.

Many dealers display their handguns by simply laying them directly on a table or in a shipping box or on a shelf. However, it is desirable to provide a more aesthetic display stand for purposes of displaying individual handguns or revolvers.

It has been known in the past to provide gun holding trays which are designed to accommodate and retain a plurality of guns and in particular pistols or revolvers. Generally, such trays have been made to receive successive reversely positioned guns with their barrels engaged with supporting means carried by the tray. Such an arrangement is shown, for example, in U.S. Pat. No. 3,329,278 to Pachmayr.

A second type of display stand is shown in U.S. Pat. No. 5,143,227 which is intended to display a multiplicity of handguns. In this arrangement, there is provided a display formed of a clear plastic which has slots designed to support a handgun in the area of the trigger guard allowing the gun to lean sideways.

It is also known in the art to provide a device for the display of rifles and such a device is illustrated in U.S. Pat. No. 3,361,265 to Wemimont. In this arrangement, there are provided first and second vertical half saddle members detachably joined together to form a vertical U-shaped opening therebetween.

While all of the above provide display stands, they do not provide a secure display stand wherein a handgun is protected against theft.

SUMMARY OF THE INVENTION

It is therefore an object of the present invention to provide a display device for a handgun.

It is a further object of the present invention to provide a display device for a handgun wherein the handgun is securely retained against possible theft.

According to one aspect of the present invention, there is provided a display stand for a gun, the display stand comprising a base, a stanchion extending upwardly from the base, a post movably mounted on the stanchion such that the post may be vertically adjusted with respect thereto, and a retaining assembly extending outwardly from a distal end of the post, the retaining assembly having first and second cooperative clamping members arranged to receive a gun barrel therebetween.

According to a further aspect of the present invention, there is provided, in combination, a display stand and a gun, the display stand comprising a base, a stanchion extending upwardly from the base, a post movably mounted on the stanchion such that the post may be vertically adjusted with respect thereto, and a retaining assembly extending outwardly from a distal end of the post, the retaining assembly having first and second cooperative clamping members therein, the gun having a barrel clamped between the first and second cooperative clamping members such that the gun is elevated above and does not contact the base.

The display stand of the present invention may be utilized in a number of different environments. Thus, it may be suitable for use in the retail establishment selling the firearm, for use either in the case or on the top thereof. As will be seen from the discussion hereinbelow, there are provided various safety features which act to deter the theft of the handgun.

As aforementioned, the display stand includes a base which may be of any suitable size or configuration. Preferably, the base is made sufficiently large and of a material that will provide a stable support. Conventionally, the base will be formed of a metallic, plastic or wood material and conveniently could be of a rectangular configuration.

The stanchion is an upright member extending upwardly from the base and acts as the main vertical support member. In a preferred embodiment, the stanchion is adjustable in a horizontal direction such that it may be placed to receive different size handguns. Thus, it may be moved horizontally either for aesthetic reasons or alternatively, to provide a better balance for the display stand.

The stanchion acts as a frame member and is designed to receive an adjustable post which slidably engages the stanchion. In this arrangement, the post may be adjusted vertically to a desired height. Frequently, it is desirable to display the handgun without the handgun touching the base and accordingly, the post is desirably vertically adjustable in order to accomplish this. The adjustability of the post also allows the same to be adjusted for different dimensions of handguns.

The retaining assembly is designed to retain the handgun positioned over the base plate. It is important that the retaining assembly be able to grip the barrel portion of a handgun and retain the same in an elevated position. It is also important that it do so in a secure manner such that removal of the handgun from the display stand is difficult.

The retaining assembly preferably comprises first and second clamping members, each of the clamping members having respective facing clamping surfaces. The members have formed therebetween a recess designed to receive the barrel of a handgun. There are also provided means for securing the two members together.

In a preferred embodiment, one of the clamping members may be formed integrally with the post with the other clamping member being separate therefrom. Means are provided for attaching the two members together and to this end, a screw threaded element may be provided.

In order to provide further security, the two members may have, on their facing surfaces, a tenon and mortice arrangement which function in a horizontal direction. Thus, one clamping member may be slidably engaged with the other, but vertical movement thereof is prevented. The two clamping members may then be secured in position.

In order to provide further security, the post may have a cable extending therefrom and one end of such a cable being designed to be secured to a substrate by any suitable means. This will prevent the post and associated retaining assembly from being removed as a unit with the handgun.

With respect to one of the clamping members being formed integrally with the post, it is preferably the lower clamping member that is so formed although it is within the scope of the invention that the upper clamping member may form integral part of the post with the lower clamping member being a part therefrom.

Conveniently, the device may be provided with a plate which is designed to receive an identification label.

BRIEF DESCRIPTION OF THE DRAWINGS

Having thus generally described the invention, reference will be made to the accompanying drawings illustrating an embodiment thereof, in which.

DESCRIPTION OF THE PREFERRED EMBODIMENTS

Figure 1:
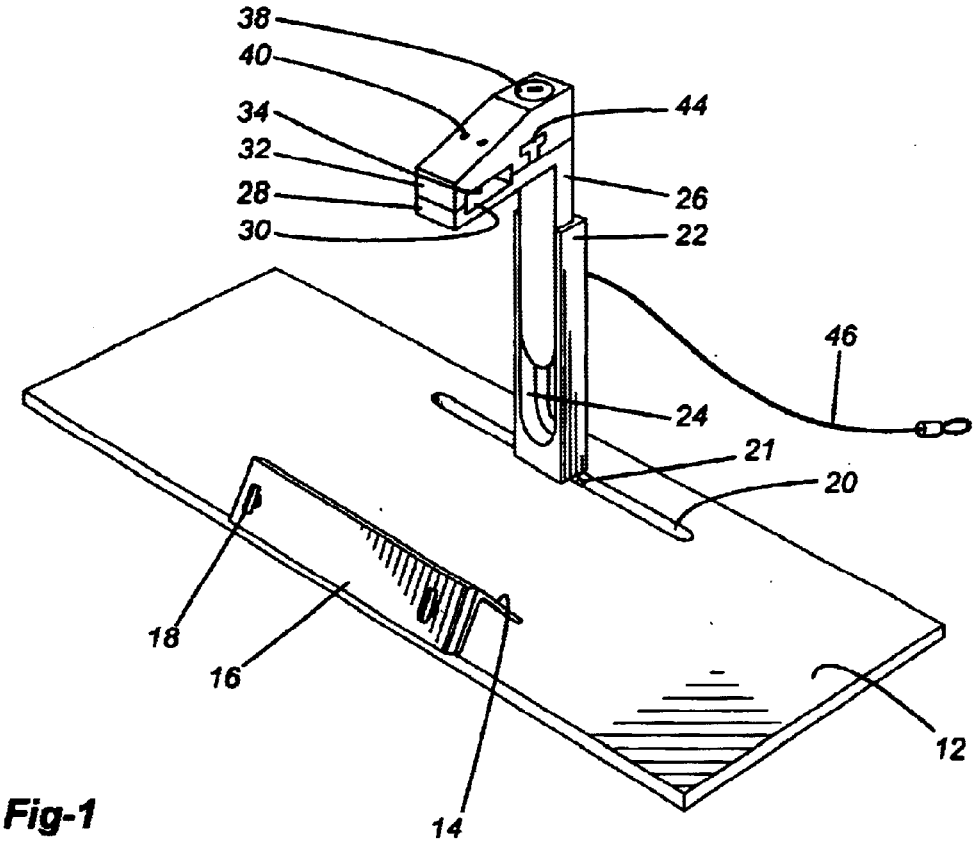
FIG. 1 is a perspective view of a gun display device according to an embodiment of the present invention.
Figure 2:
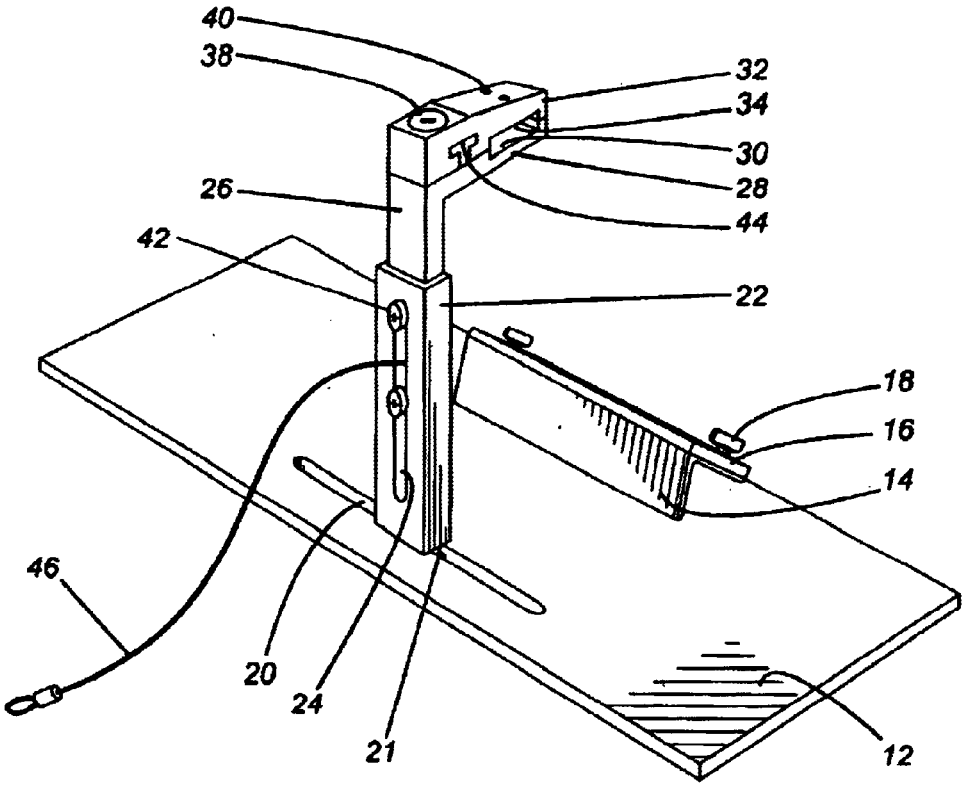
FIG. 2 is a rear perspective view thereof.

Referring to the drawings in greater detail and by reference characters thereto, there is illustrated in FIGS. 1 and 2 a gun display device which is generally designated by reference numeral 10.

Gun display device 10 has a base 12 which is of a generally rectangular configuration. Located proximate a front side edge is an inverted V-shaped support member 14. Support member 14 is used to set forth an identification plaque 16 which may be mounted thereon by means of retaining screws 18.

Situated proximate the rear side edge of base 12 is a slot 20 which is designed to receive a stanchion 22. As will be noted, slot 20 is elongated and thus stanchion 22 may be mounted in different locations therein by means of locking means 21.

Stanchion 22 includes a vertically extending slot 24 which, as may be seen from FIGS. 1 and 2, has a greater width at the front than at the rear thereof for reasons which will become apparent hereinbelow.

Mounted in slot 24 is a post 26 which is connected with a lower clamping member 28. Lower clamping member 28 includes a lower clamping member recess 30.

Secured to lower clamping member 28 is an upper clamping member 32 which includes an upper clamping member recess 34. Recesses 30 and 34 define therebetween a barrel receiving seat.

As may be seen in FIGS. 1 and 2, there is provided a screw threaded locking member 38 for securing and locking together lower clamping member 28 and upper clamping member 32. Adjustability is provided by means of securing screws 40 which are arranged to secure a gun barrel in a desired position.

In order to provide for the desired adjustability locking screws 42 are designed to lock post 26 in a desired position. However, since it would be possible for somebody to unscrew screws 40 and remove post 26, a locking cable 46 is provided and which locking cable has one end secured to post 26 with another end designed to be suitably secured to a substrate.

Furthermore, to prevent the prying open of the device, lower clamping member 28 includes an upwardly extending T-shaped tenon 44 which mates with a corresponding mortice formed in upper clamping member 32. Thus, the mere loosening of locking member 38 will not permit removal of the gun without the complete removal of upper clamping member 32.

It will be understood that the above described embodiments are for purposes of illustration only and that changes or modifications may be made thereto without departing from the spirit and scope of the invention.

We claim:

1. A display stand for a gun, said display stand comprising:

a base;

a stanchion extending upwardly from a position proximate a marginal edge of said base;

a post movably mounted on said stanchion such that said post may be vertically adjusted with respect thereto; and a retaining assembly extending outwardly from a distal end of said post in a direction away from said marginal edge of said base, said retaining assembly having a first and second cooperative clamping members arranged to receive a gun barrel therebetween, said first and second clamping members being located above said base, wherein each of said first and second clamping members have first and second clamping surfaces respectively in a facing relationship, one of said first and second clamping surfaces having a tenon formed thereon, and a second one of said clamping surfaces having a mortise formed therein, the arrangement being such that said tenon will fit within said mortise to prevent vertical movement between said first and second clamping members.

2. The display device of claim 1 wherein each of said tenon and said mortise have a generally T-shaped configuration.

3. The display device of claim 1 wherein said stanchion is mounted to said base so as to be movable horizontally therealong.

4. The display device of claim 1 wherein said stanchion has a recess formed therein, said post fitting within said recess in a slidable manner, and locking means for retaining said post in a desired position.

5. The display stand of claim 4 further including a cable member, a first end of said cable member being secured to said post such that a second end of said cable may be secured to a substrate.

6. The display device of claim 2 further including a display plate mounted on said base, said display plate being designed to receive an identification label.

7. In combination, a display stand and a gun, said display stand comprising:

a base;

a stanchion extending upwardly from said base;

a post movably mounted on said stanchion such that said post may be vertically adjusted with respect thereto; and a retaining assembly extending outwardly from a distal end of said post, said retaining assembly having a first and second cooperative clamping members therein, said gun having a barrel clamped between said first and second cooperative clamping members such that the gun is elevated above and does not contact the base, has been added before "wherein each".

wherein each of said first and second clamping members have first and second clamping surfaces respectively in a facing relationship, one of said first and second clamping surfaces having a tenon formed thereon, and a second one of said clamping surfaces having a mortise formed therein, the arrangement being such that said tenon will fit within said mortise to prevent vertical movement between said first and second clamping members.

* * * * *